US010433645B2

(12) United States Patent
St. Mary

(10) Patent No.: US 10,433,645 B2
(45) Date of Patent: Oct. 8, 2019

(54) ERGONOMIC SEATING DEVICE

(71) Applicant: John St. Mary, Geneva (CH)

(72) Inventor: John St. Mary, Geneva (CH)

(73) Assignee: Solvaseat SA, Carouge (CH)

( * ) Notice: Subject to any disclaimer, the term of this patent is extended or adjusted under 35 U.S.C. 154(b) by 0 days.

(21) Appl. No.: 15/539,440

(22) PCT Filed: Dec. 30, 2015

(86) PCT No.: PCT/EP2015/081461

§ 371 (c)(1),
(2) Date: Jun. 23, 2017

(87) PCT Pub. No.: WO2016/107923

PCT Pub. Date: Jul. 7, 2016

(65) Prior Publication Data

US 2018/0027971 A1 Feb. 1, 2018

(30) Foreign Application Priority Data

Dec. 30, 2014 (CH) ..... 2053/2014

(51) Int. Cl.

| | |
|---|---|
| ***A47C 7/02*** | (2006.01) |
| ***A47C 7/40*** | (2006.01) |
| ***A47C 7/42*** | (2006.01) |
| ***A47C 7/46*** | (2006.01) |
| ***A47C 9/00*** | (2006.01) |

(52) U.S. Cl.

CPC ..... *A47C 7/021* (2013.01); *A47C 7/407* (2013.01); *A47C 7/425* (2013.01); *A47C 7/46* (2013.01); *A47C 9/005* (2013.01)

(58) Field of Classification Search

CPC ..... A47C 7/021; A47C 7/022; A47C 7/407; A47C 7/425; A47C 7/42; A47C 7/46; A47C 9/005

USPC ..... 297/452.21, 452.24, 452.26, 452.28, 297/452.29, 452.3, 452.31

See application file for complete search history.

(56) References Cited

U.S. PATENT DOCUMENTS

| | | | | |
|---|---|---|---|---|
| 3,376,070 A | | 4/1968 | Johnson | |
| 3,503,649 A | * | 3/1970 | Johnson | A47C 7/029 297/452.26 |
| 3,632,150 A | * | 1/1972 | Milakovich | A47C 4/02 297/440.15 |

(Continued)

FOREIGN PATENT DOCUMENTS

| | | |
|---|---|---|
| JP | 2006-311946 A | 11/2006 |
| JP | 2011-254878 A | 12/2011 |

*Primary Examiner* — Mark R Wendell

(74) *Attorney, Agent, or Firm* — Dinsmore & Shohl LLP; Weston R. Gould

(57) ABSTRACT

Seating device (1) comprising a base plate (2) for a user to sit on and a pelvic support (3) for supporting in a vertical position the pelvis of a user sitting on said base plate (2) without supporting or immobilising said user's vertebrae, wherein said pelvic support (3) is configured for contacting said pelvis (9) at the posterior superior iliac spines (PSIS) (91) and/or at the iliac crests (92), without any contact to said user's vertebrae wherein said seating device is configured for maintaining an angle of 93° to 97° between the vertically supported pelvis (9) and the femoral bones of said user. In embodiments, the seating device includes a mechanism to encourage the user's upper body mobility, for example a convex base.

20 Claims, 11 Drawing Sheets

(56) References Cited

U.S. PATENT DOCUMENTS

Figure 1:
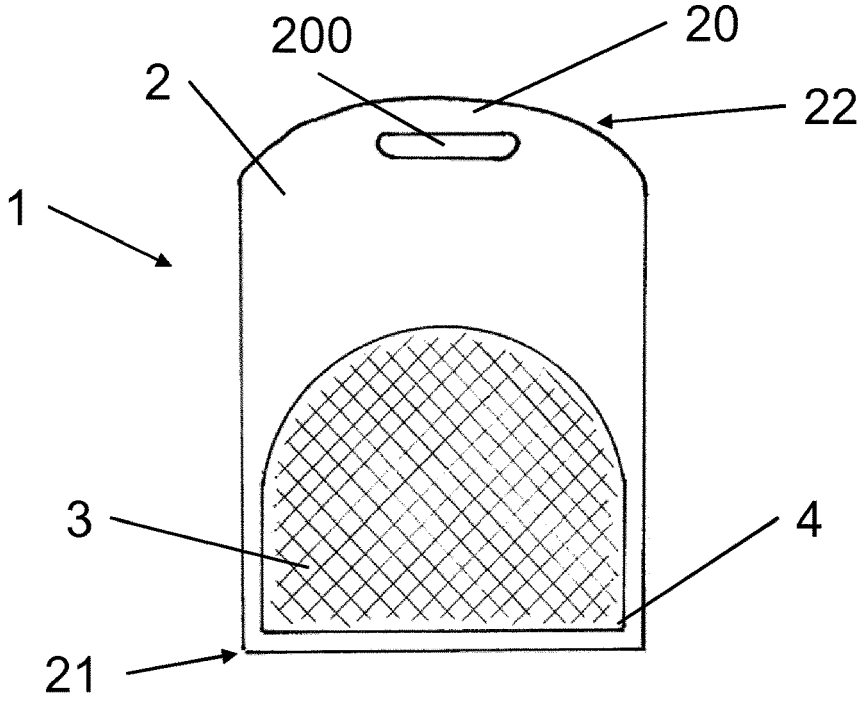

| | | | | |
|---|---|---|---|---|
| 4,595,234 | A | 6/1986 | Kjersem | |
| 4,668,015 | A * | 5/1987 | Kjersem | A47C 7/029 297/452.21 |
| 5,649,739 | A * | 7/1997 | Zapf | A47C 7/405 297/284.4 |
| 6,983,991 | B2 * | 1/2006 | Strona | A47C 7/021 297/313 |
| 6,997,513 | B2 * | 2/2006 | Ige | A47C 9/027 248/174 |
| 8,721,004 | B2 * | 5/2014 | Wuang | A47C 7/022 297/440.22 |
| 10,040,379 | B2 * | 8/2018 | Dellanno | B60N 2/42709 |
| 2006/0012227 | A1 * | 1/2006 | Obermaier | A47C 7/021 297/219.1 |
| 2006/0181136 | A1 | 8/2006 | Gaffney | |
| 2007/0057562 | A1 * | 3/2007 | Gregory | A47C 7/029 297/452.21 |
| 2010/0033003 | A1 * | 2/2010 | Sandberg | B60N 2/24 297/325 |
| 2011/0277246 | A1 * | 11/2011 | Willingham | A47C 3/12 5/653 |
| 2011/0304192 | A1 * | 12/2011 | Augustat | A47C 1/03255 297/452.23 |
| 2014/0183924 | A1 * | 7/2014 | Cvek | A47C 9/002 297/452.18 |
| 2015/0015042 | A1 * | 1/2015 | Willingham | A47C 7/46 297/284.7 |
| 2016/0262544 | A1 * | 9/2016 | Song | A47C 3/16 |
| 2017/0231393 | A1 * | 8/2017 | Walker | A47C 7/40 297/284.8 |

* cited by examiner

ERGONOMIC SEATING DEVICE

The present invention relates to an ergonomic seating device. The present invention relates in particular to an ergonomic seating device providing correct pelvic support and spinal alignment to a user.

A fundamental medical problem related to back pain, postural distortion and compressed spinal nerves is pelvic and spinal alignment and support while seated. It is a fact that the spine rests on top of the pelvis. It is therefore unavoidable that anything affecting the posture or stability of the pelvis in an upright person will also affect the spine. This applies seated posture just as much as standing posture.

Without internal or external pelvic support, sitting with 90° hip flexion flattens the lumbar curve. This happens for two reasons: we sit on two rounded bones, the ischial tuberosities, with a posterior pitch, and our hip extensor muscles tend to pull these bones toward the lower legs. Unless the seated person tightens the hip flexors to counteract these two forces, the pelvis rolls back and flattens the lumbar spine. This flattened curve compresses the lumbar inter-vertebral discs.

Thus, to protect our spine, we unconsciously contract several muscles to hold the pelvis and lumbar spine erect. These contractions require attention and effort, creating fatigue and limiting concentration. Prolonged isometric contraction of these hip and back muscles may furthermore have many consequences such as for example limited mobility, stiffness, pain, lordosis, damage to the articulations in the hips and the spinal column, herniated spinal discs and nerve compression, as well as dorsal thoracic muscle tensions, slouched posture, stiff neck and shoulders, paradoxical breathing and the resulting stress, headaches, etc.

Currently proposed solutions for improving seated posture and thus avoiding the problems mentioned above include lumbar support systems such as for example lumbar support cushions and bolsters to support the spine. Accordingly, the spine, which is normally mobile and adapting to changing postures and needs, is immobilized by these lumbar support systems without first aligning and stabilizing the spinal column's foundation: the pelvis. Thus, these lumbar, or spinal, supports often create chronic muscle tensions and stiffness in the region of the spine. This provokes the user to move away from the support and adopt other poorly supported postures, thus defeating the purpose of the chair's support system.

Another drawback of lumbar support systems is that, in order to function, they require a chair with an existing back support to hold the system in place, and thus cannot provide support when seated on backless stools, benches, deep couches, etc.

Other currently proposed solutions for improving seated posture and thus avoiding the problems listed above include standing support devices such as saddle seats and high stools requiring the user to half-sit/half-stand. By extending the hip joints to an open posture, these devices do allow the pelvis and spine to remain loosely vertical, and eliminate the immobilized posture.

Standing support devices however have several drawbacks:

- the excessive forward slope inherent to these devices provokes the sensation of instability and slipping off the seat, thus increasing tension in the buttocks, hips, and thigh muscles, creating fatigue and stiffness;
- in the case of the saddle seats, the middle bulge impedes slipping by pressing on the pubic area, which can be uncomfortable, especially in male users, thus requiring even more legwork to avoid this pressure;
- these devices are taller than conventional chairs and require remodeling the work area;
- the excessive forward slope and the height inherent to these devices provokes forward leaning, thus flattening the lumbar spine, compressing the abdomen, creating a thoracic and cervical Curve (compressing discs) and leaning onto the desk.

An aim of the present invention is thus to provide an ergonomic seating device that maintains vertical pelvic posture to support a naturally curved spine without requiring muscle tension to maintain the posture, thus preventing the health problems cited above.

Another aim of the present invention is thus to provide an ergonomic seating device that allows full spinal mobility.

Still another aim of the present invention is thus to provide an ergonomic seating device that provides a slightly open hip angle, preferably adjustable within a limited range, without adding weight to the legs.

Another aim of the present invention is thus to provide an ergonomic seating device that is adaptable to a variety of existing seating surfaces in terms of depth, seat back.

Yet another aim of the present invention is thus to provide an ergonomic seating device that encourages mobility without creating muscle strain.

These aims and other advantages are achieved with ergonomic seating devices comprising the features of independent claim 1.

These aims and other advantages are achieved in particular with an ergonomic seating device comprising a base plate for a user to sit on; and a pelvic support for supporting in a vertical position the pelvis of a user sitting on said base plate without supporting or immobilising said user's vertebrae, wherein said pelvic support is configured for contacting said pelvis at the posterior superior iliac spines (PSIS) and/or at the iliac crests, without any contact to the user's vertebrae, wherein the seating device is configured for maintaining an angle of 93° to 97° between the vertically supported pelvis and the femoral bones of the user. In embodiments, the seating device includes a mechanism to encourage the user's upper body mobility, for example a convex base.

In embodiments, the seating device is foldable and further comprises a hinge, for attaching the pelvic support at or near a back edge of the base plate such that when the seating device is in a folded position, the pelvic support lies substantially parallel to the base plate, and when the seating device is in an unfolded position the pelvic support is stopped at an angle of between 93° and 97° with an upper side of the base plate.

In embodiments, the base plate is thicker at the back edge than at a front edge. An upper side of the base plate for example forms an angle comprised between 3° and 7°, for example of substantially 5°, with a lower side of the base plate, wherein the pelvic support is stopped at an angle of substantially 90° with the lower side of the base plate when the seating device is in an unfolded position.

The seating device for example comprises an adjustable extension device for maintaining a lower side of the base plate in a horizontal position when the seating device lies on an inclined surface. The adjustable extension device is for example attached to the base plate at or near the back edge and/or to the vertical pelvic support element. The adjustable extension device for example allows maintaining a lower side of the base plate in a horizontal position when the seating device lies on a surface inclined at up to 20°. In embodiments, the adjustable extension device is continuously adjustable.

In embodiments, the base plate comprises means for indicating the inclination of the base plate. The means for indicating the inclination of the base plate for example comprises a bubble level. In embodiments, the means for indicating the inclination of the base plate comprises wireless transmission means for wirelessly communicating with a remote handheld device, for example to a smartphone, which can then display information about the inclination of the base plate to a user, for example through a specific application installed on the handheld device.

In embodiments, the seating device further comprises a handle for carrying the seating device in a folded position. The handle for example comprises a hole cut out at a front edge of the base plate.

In embodiments, the seating device further comprises a locking mechanism for holding the pelvic support against the base plate when the seating device is in its folded position.

In embodiments, the seating device further comprises a mechanism for stopping the pelvic support at an angle of substantially 90° with the lower side of the base plate when the seating device is in its unfolded position.

In variant embodiments, the seating device of the invention is a chair and further comprises at least one foot for holding the base plate over the ground, an upper side of said base plate may be adjustable within the range of 3° to 7° with the ground, the pelvic support being substantially vertical and forming a low backrest of the chair.

The height of the pelvic support over a back edge of the base plate, when the seating device is in its unfolded position if applicable, is lower or equal to 24 cm. Preferably, the height of the pelvic support is comprised between 16 cm and 24 cm.

In a further variant, the chair comprises an adjustment lever for the seat height and an adjustment lever for the seat pan angle.

In embodiments, the seating device of the invention is portable, versatile and adjustable to a large variety of chairs or seats. It uses the seated person's bodyweight to stabilize a vertical rigid support behind the pelvis. This rigid support presses onto the posterior surface of the pelvic bones of the seated person, thereby creating a third support point for the pelvis in addition to the first two support points, namely the two ischial tuberosities.

For maximal stability, support points are preferably spread apart. The posterior iliac tuberosities at the sacro-iliac junction are the highest point of the hip bones, i.e. the farthest away from the ischial tuberosities, that can be easily supported by an exterior object. The seating device of the invention creates a third support point on these bony structures and thus provides maximal stability to the pelvis while maintaining it in a vertical position. Once the pelvis is supported vertically in the seating device of the invention, the user may relax his or her pelvic musculature, thus eliminating the formation of chronic muscle tension in the pelvic and lumbar regions.

The device of the invention supports the pelvis in a vertical position without muscular effort and raises the hip joints slightly, thus shifting the user's weight distribution and inducing further relaxation of the pelvic musculature. Since there is no spinal support from the device, it leaves the spinal column free to move and adapt. The pelvis being fixed in a vertical position, it spontaneously realigns the spine and upper body into the standing posture's alignment without additional muscular effort.

The seating device of the present invention thus allows achieving the aims listed above by innovating a pelvic-only support system tied to an open seat pan angle, in the range of 93 to 97 degrees, preferably of 95°, and adds several features enlarging the device's usability and adaptability.

The seating device of the invention passively supports the pelvis in a vertical position, thereby allowing the user to completely relax the pelvic and lumbar musculature. The seating device of the present invention also provides a stable support for the spinal column in its neutral anatomical curve without contacting the spinal column thus allowing natural spinal mobility while maintaining pelvic support. The seating device of the present invention further provides a seated pelvic-femoral angle that facilitates pelvic verticality and a normal spinal curve without increasing muscular workload. The seating device of the present invention forms a seat pan structure that allows and encourages the user to shift their weight forward and back or laterally, preferably up to 10°, and mobilize upper body structures while maintaining the fixed pelvic-thigh flexion angle of 93°-97°.

In embodiments, the ergonomic seating device of the present invention can be adapted to almost any type of existing chair, bench, couch or other seat, while maintaining the above-mentioned support.

In embodiments, the pelvic support is T-shaped and thus comprises lateral support elements configured for additionally contacting said pelvis at the iliac crests.

In embodiments, the base plate comprises depressions for lodging ischial tuberosities of a user seating on the seating device, thereby providing additional support for vertically aligning the user's pelvis.

According to the invention, the seating device allows supporting the pelvis of a user seating on the seating device in a neutral, vertical position. A vertical pelvis, which corresponds to the pelvic position in a healthy standing person, is structured to act as a foundation of support for the spinal column, and simultaneously allows mobility in the hips and the spine. A pelvis tilted forward or back destabilizes the foundation, creates the need for rigid muscle tensions to support the upper body against the pull of gravity, alters spinal curves and compresses inter-vertebral discs.

However, with a passive seating device according to the invention supporting and maintaining pelvic verticality, the normal lumbar spinal curve is maintained, just as if the person is standing. This passively supported verticality of the pelvis is further facilitated with hip flexion at less than 90°, which is easily achieved in embodiments of the invention with a forward-tilted seat pan, or base plate. Verticality of the pelvis is defined as normal or neutral sagittal balance, measured in various ways, such as ASIS-PSIS angle or sacral slope.

The seating device of the invention, contrary to lumbar supports, maintains the pelvic verticality while allowing full freedom of movement in the spinal column. The spinal column has evolved to allow freedom of movement, and is curved to act as an elastic shock absorber. Blocking spinal mobility via external support limits its functionality and creates secondary problems. With direct support of the pelvis and no pressure on the lumbar vertebrae, as achieved with the seating device of the invention, the spinal column retains its natural mobility. As the spine's mobility begins at its base, the L5-S1 articulation, immobilizing pressure on any part of the spine limits its mobility and should thus be avoided.

There are several advantages to spinal mobility. It is commonly accepted that trunk and spinal movement naturally cycles loading and relief of muscles and inter-vertebral discs, enhances hydration of the inter-vertebral discs, maintains the flexibility of the inter-vertebral articulations (muscles, fascia and joint capsules), encourages blood circulation through the musculature, prevents chronic muscle loading and the resulting hypertension, and encourages concentration and performance. Pressure on the lumbar vertebrae impedes this mobility.

On the other end, spinal column support, as is the case in prior art devices, can create problems. It has been shown that lumbar support without pelvic support creates a kyphosis and flattens the lumbar spine by inducing pelvic retroversion, 8-9° when typing, and up to 21° when reading the screen or watching videos, thus creating severe compression of the inter-vertebral discs. This is because, in practice, the seated person looks for stability by moving the buttocks forward to stabilize the trunk on the backrest.

According to the invention, the seating device comprises a base plate, or seat pan, which is inclined forward in a range of 3° to 7°. Aforward-inclined seat pan surface brings further benefits. It has been shown that whereas a flat seat pan flattens the lumbar curve and compresses inter-vertebral discs, a forward-sloping seat pan (saddle seats, half-seated/half-standing chairs) and other postures allowing hip flexion at more than 90°, for example 120°-160°, encourages a normal spinal curve, approaching standing pelvic alignment and spinal curves, and reduces stiffness and pain complaints. Furthermore, the postures allowing the greatest volitional mobility are sitting on a forward sloping seat pan, with no spinal support, and standing. These postures also place the lumbar curve at the mid-point of its normal range of motion.

Too much forward tilt however creates a new set of problems. Excessive forward slope provokes the sensation of instability and slipping off the seat, provoking legwork and tension. Increased slope furthermore redistributes body weight to the legs increases work, fatigue and stiffness. Excessive forward slope provokes forward leaning, thus flattening the lumbar spine, compressing the abdomen, creating a thoracic and cervical Curve (compressing discs) and leaning onto the desk.

Searches within the frame of the present invention have shown that an inclination angle less than 3° is perceived as the same as 0°. An inclination angle of 3° or more for the base plate of the seating device results in users feeling "more relaxed", experiencing less pressure on the posterior pelvis, less "pinched" in the groin area and/or more relaxed in the buttocks region. However, at an inclination of more than 7°-8°, a user seating on the seating device would have a tendency to slide forward and feeling unstable, even with a non-slip surface on the base plate, and/or would have too much weight on his or her legs and feet, causing muscle tightening ("work") in his or her thighs. Thus, according to the invention, the forward slope of the base plate of the seating device, that facilitates comfortable vertical pelvic alignment without causing the above-listed problems is from 3° to 7°.

According to the invention, the seating device provides to a user seating on it freedom of movement while maintaining proper pelvic support. An immobilizing seat structure creates discomfort and tension. Users of fixed-structure "ergonomic" seats quickly abandon the rigid support structure so that they can shift their weight and move their upper body. Unfortunately, in doing so, they lose all the advantages of the seat's ergonomic support structure. According to the invention, the user seating on the seating device of the invention can shift his or her weight and move his or her upper body at will while maintaining contact with the pelvic support structure. In embodiments, the seating device of the invention furthermore provides a base plate structure that allows the user to shift his or her weight and thus shift the angle of the entire device by up to 10°, thus mobilizing their upper body structures while maintaining the fixed pelvic-thigh flexion angle of 93°-97°, preferably 95°.

Figure 2A:
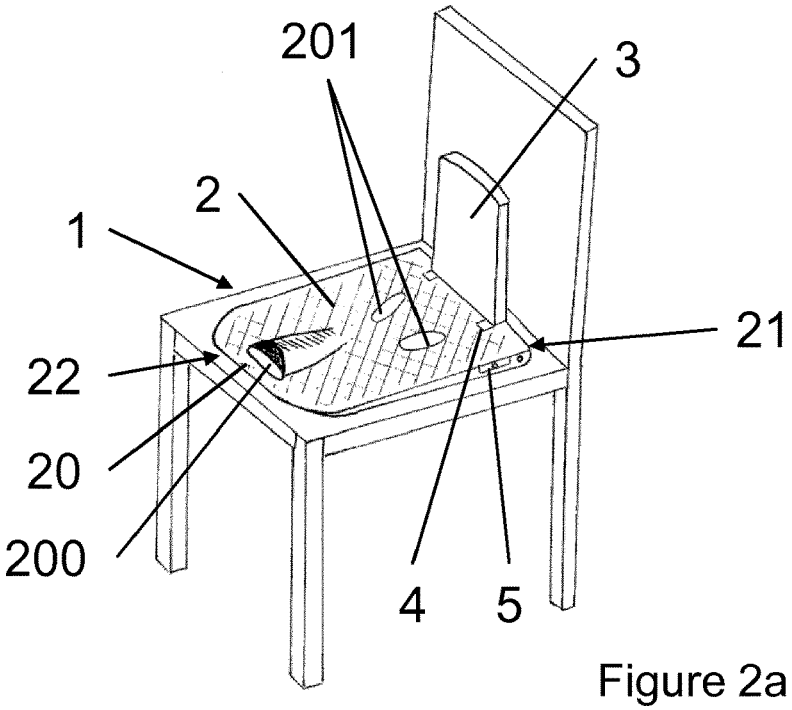
Figure 2B:
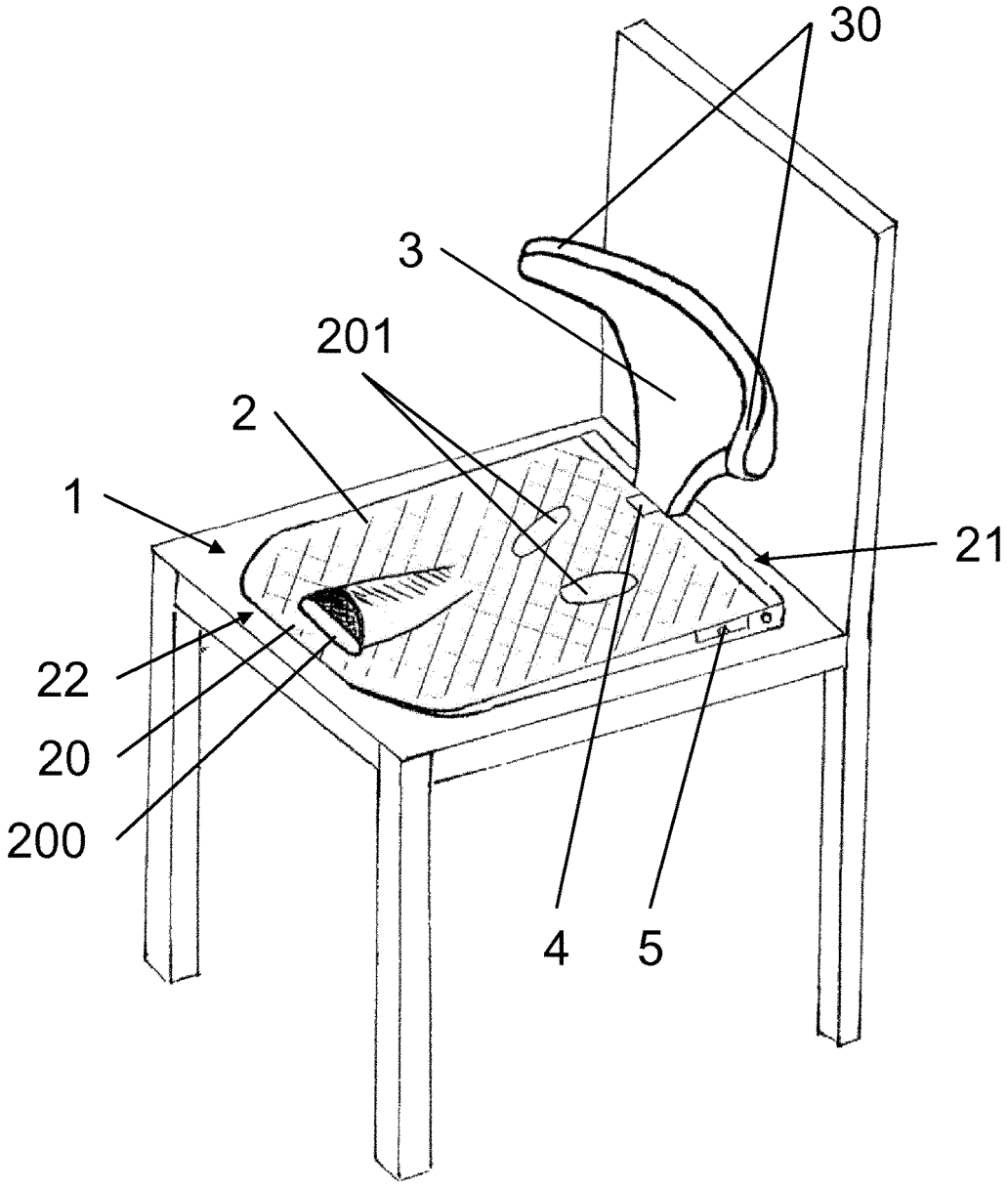
Figure 3A:
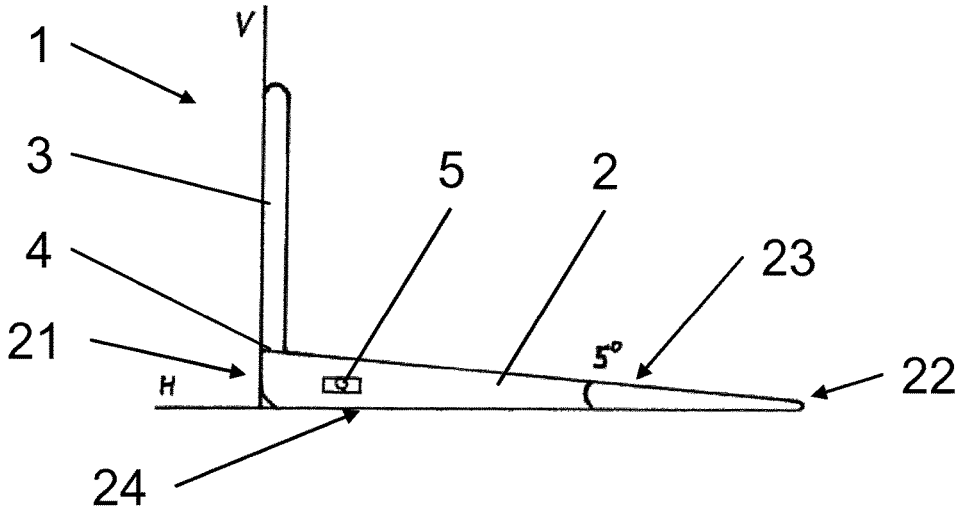
Figure 3B:
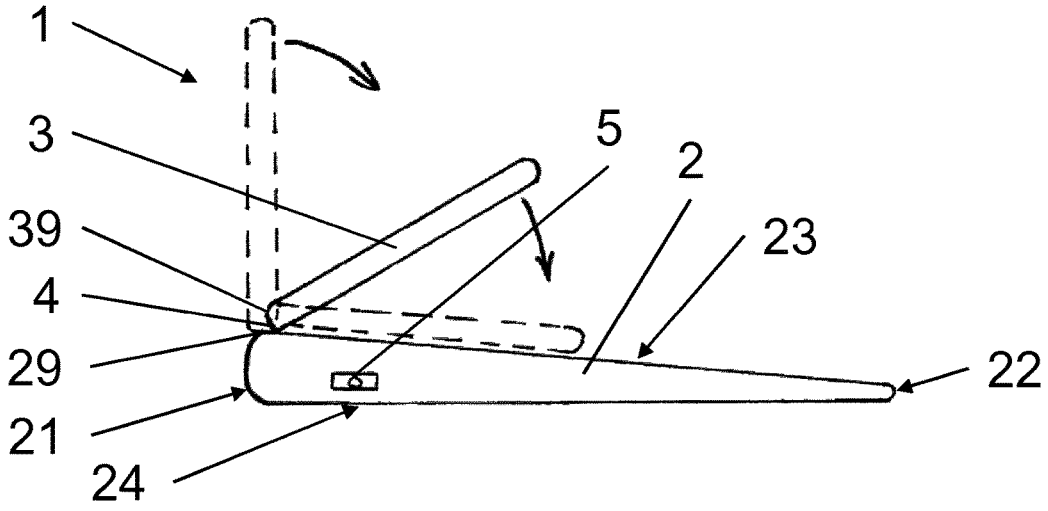
Figure 4A:
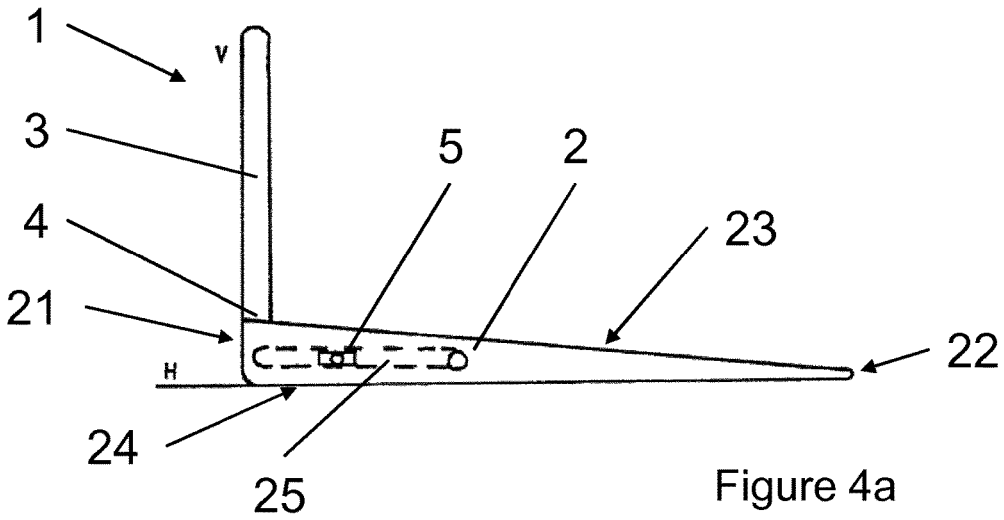
Figure 4B:
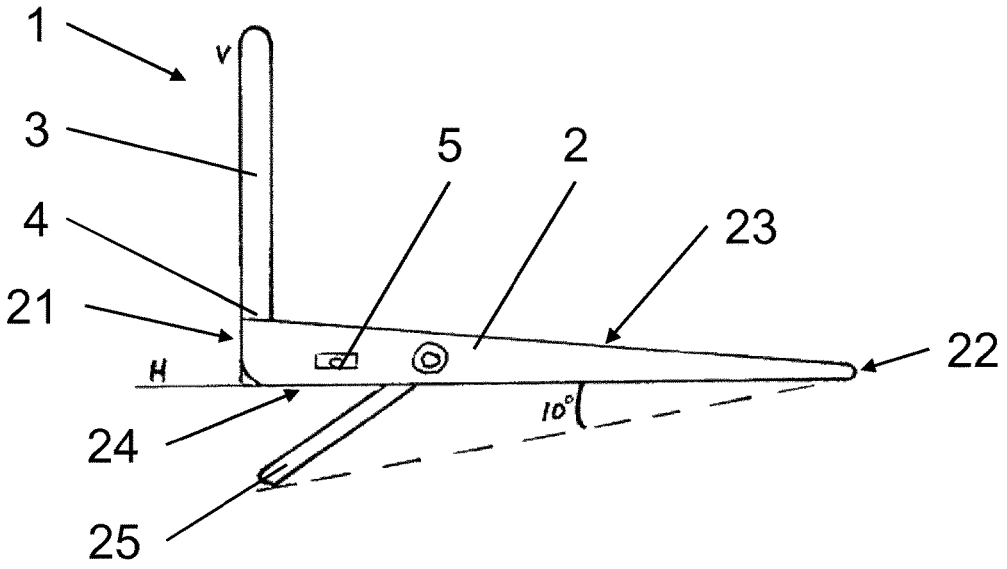
Figure 4C:
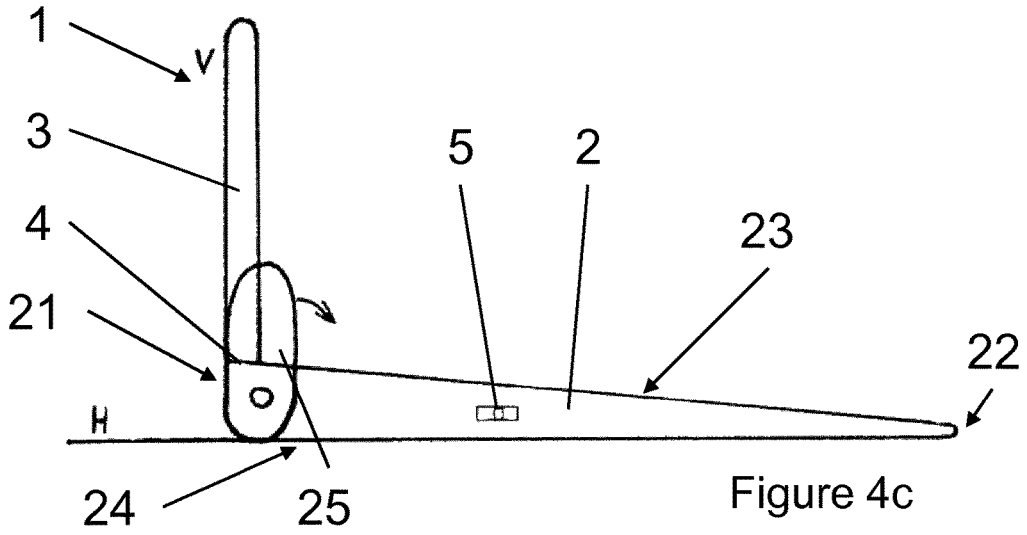
Figure 4D:
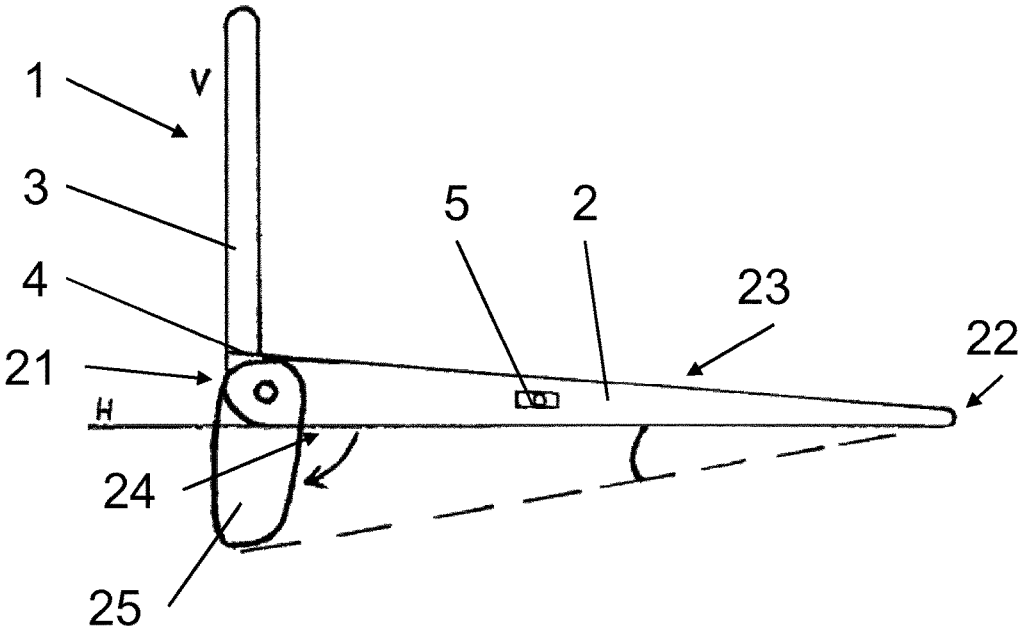
Figure 4E:
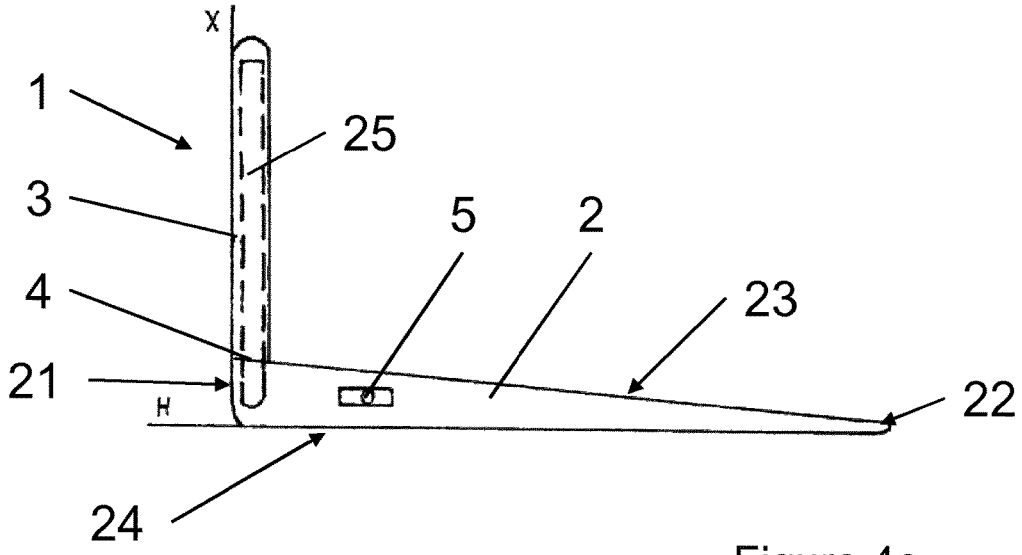
Figure 4F:
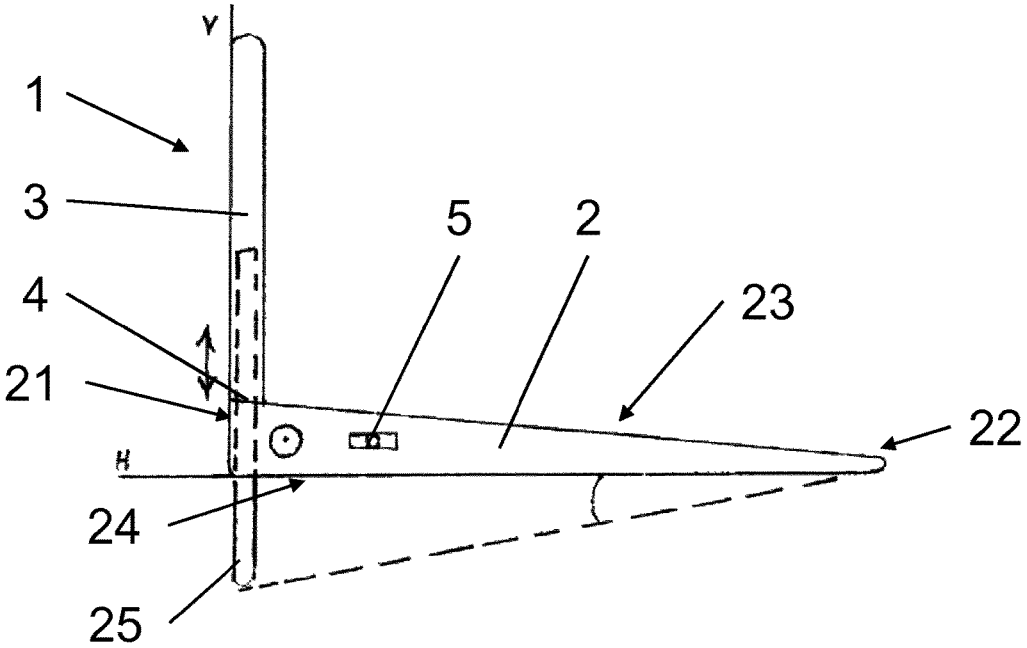
Figure 4G:
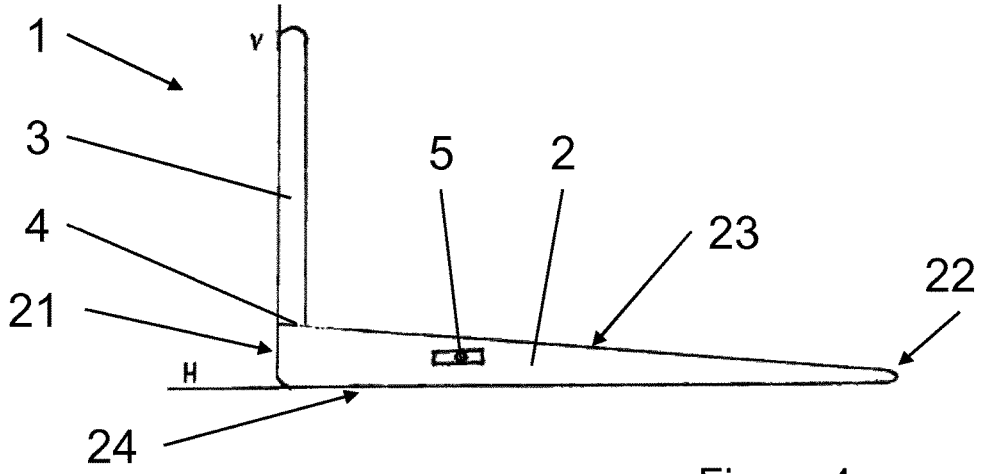
Figure 4H:
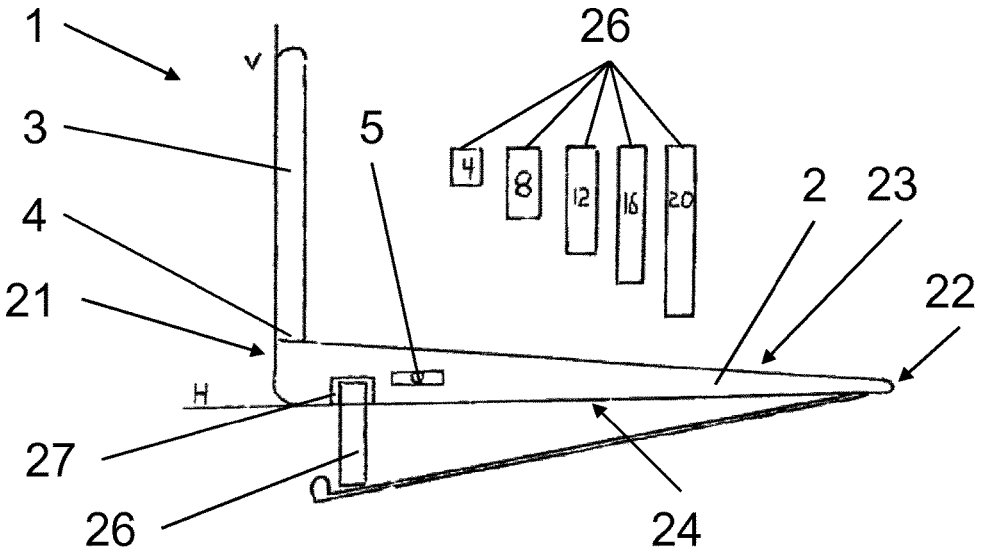
Figure 4I:
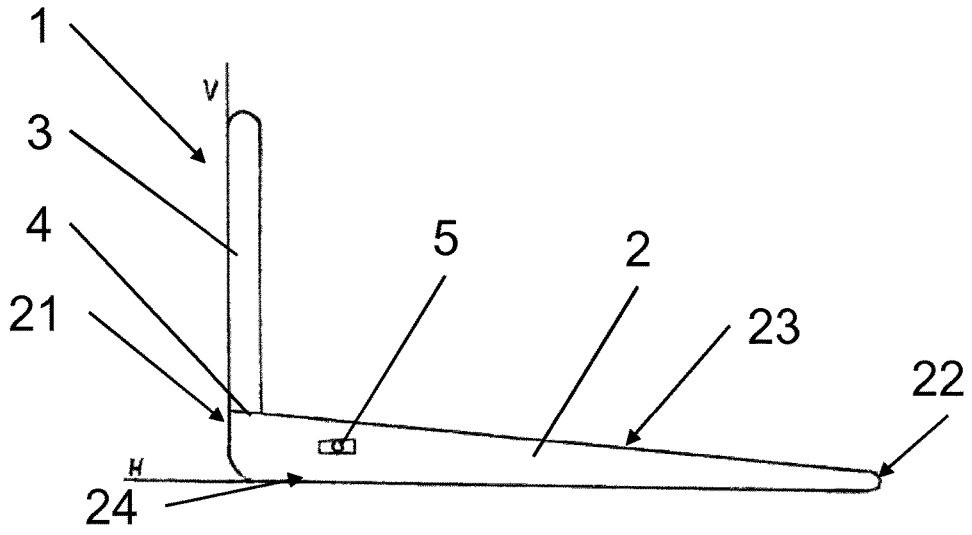
Figure 4J:
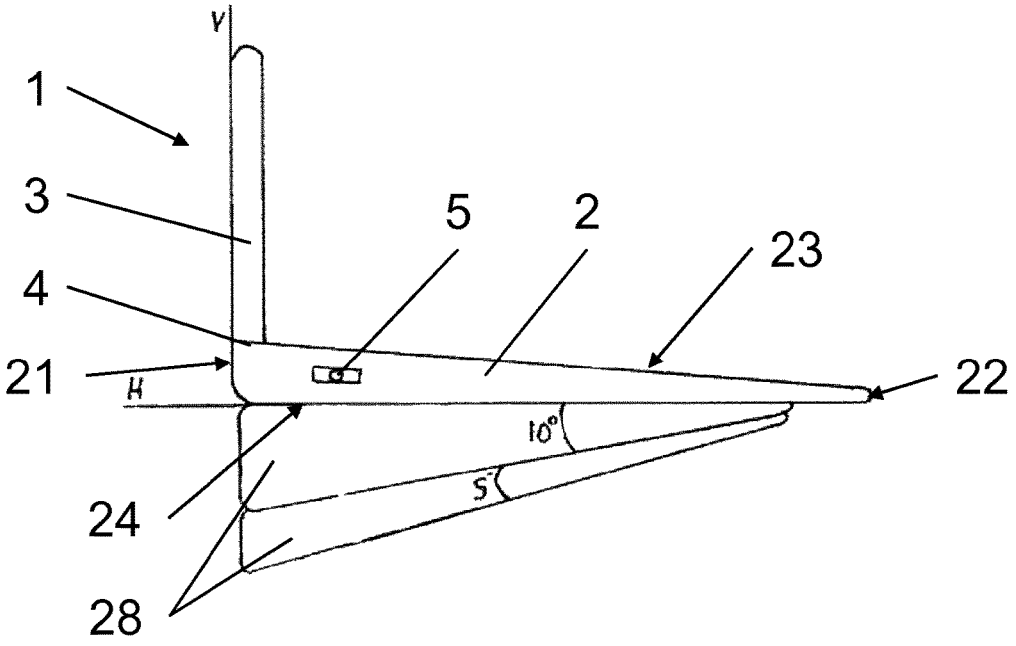
Figure 4K:
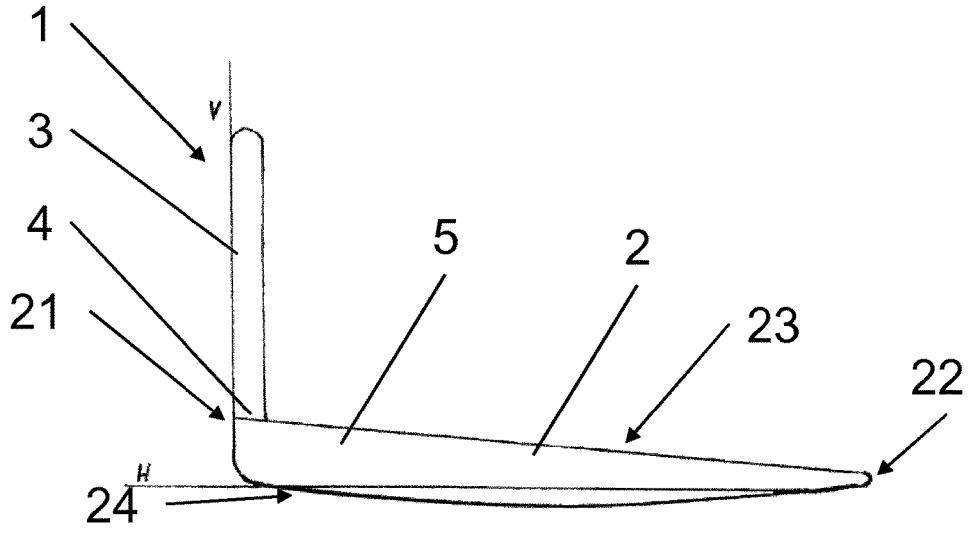
Figure 5A:
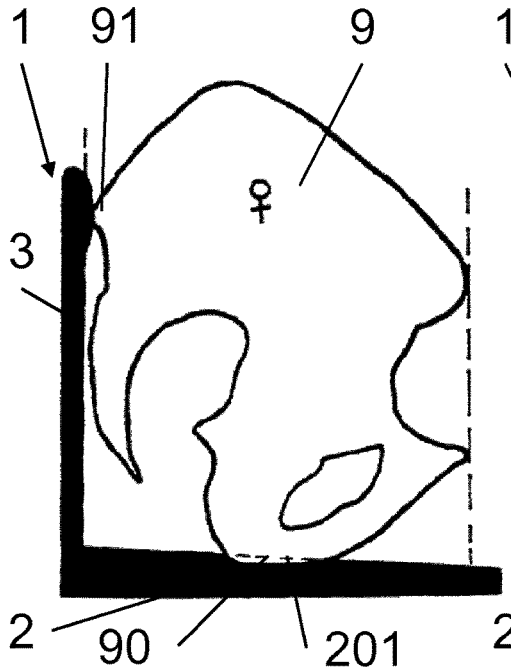
Figure 5B:
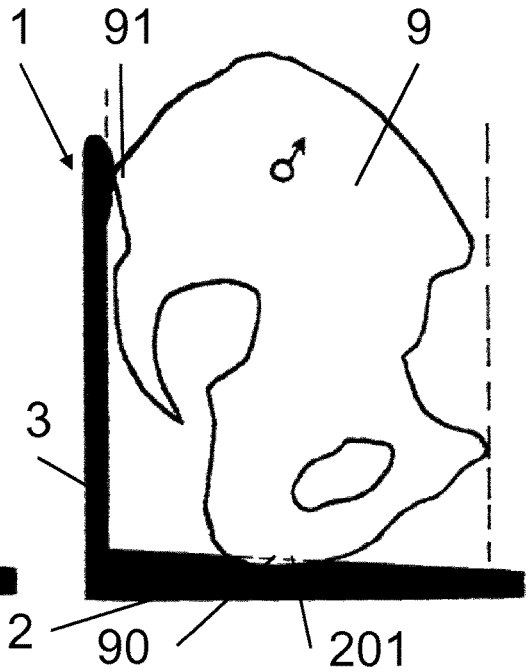
Figure 5C:
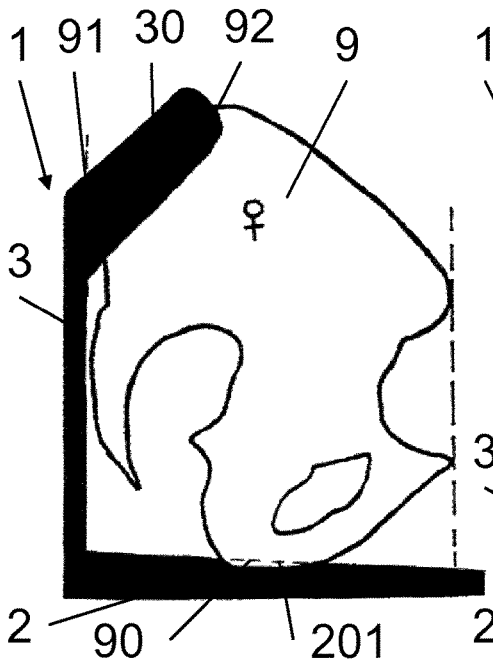
Figure 5D:
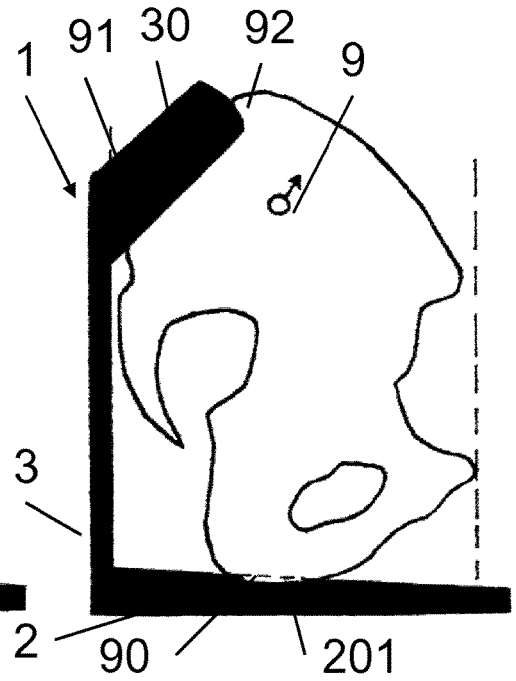
Figure 6A:
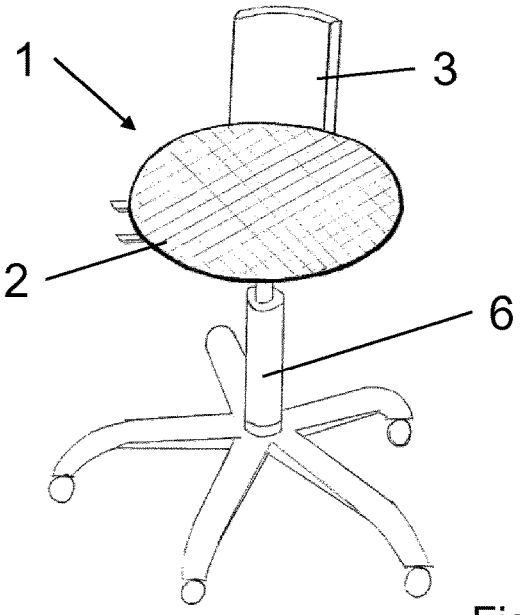
Figure 6B:
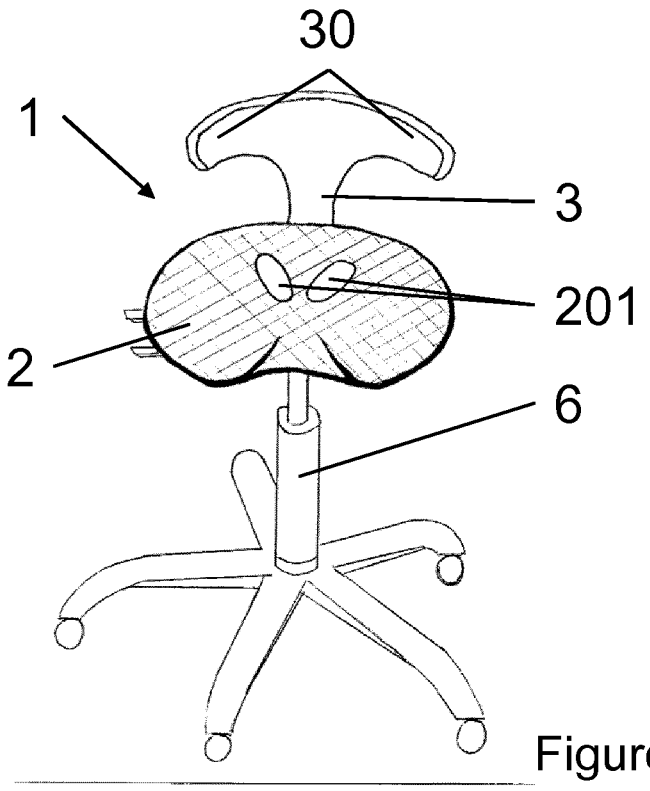
Figure 7:
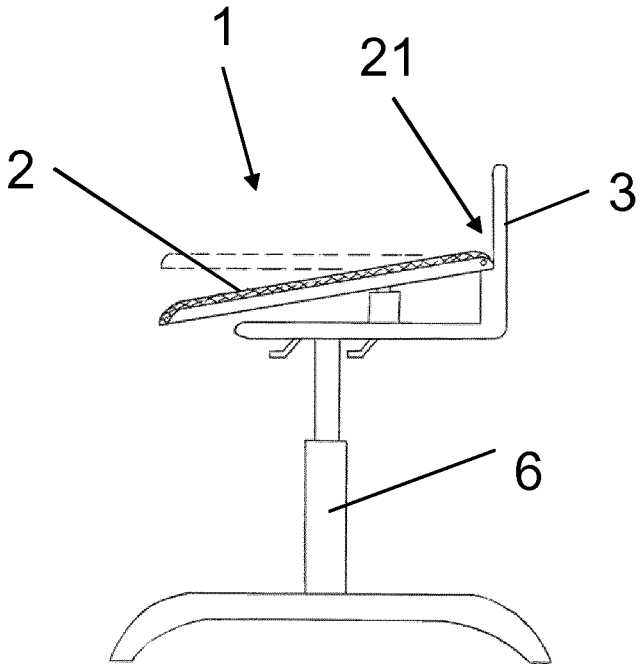

The present invention will be better understood by reading the description below, illustrated by the figures where:

FIG. 1 shows a seating device according to an embodiment of the invention in its folded position;

FIGS. 2*a* and 2*b* show seating devices according to embodiments of the invention in their unfolded position and placed on a chair, FIGS. 3*a* and 3*b* are schematic side views of a seating device according to an embodiment of the invention;

FIGS. 4*a* to 4*h* schematically illustrate variant embodiments of the seating device of the invention with various adjustable extension devices in folded and unfolded positions;

FIGS. 4*i* and 4*j* schematically illustrate yet another embodiment of the seating device of the invention without and with support wedges respectively;

FIG. 4*k* schematically illustrates still another embodiment of the seating device of the invention with a convex bottom surface that encourages mobility without creating muscle strain;

FIGS. 5*a* and 5*b* schematically show how the seating device of the invention supports the pelvis of a seated user in a vertical position;

FIGS. 5*c* and 5*d* schematically show how the seating device of the invention in variant embodiments supports the iliac crests of a seated user in a vertical position;

FIGS. 6*a* and 6*b* show seating devices according to variant embodiments of the invention in the form of a chair, FIG. 7 is a side view of the seating device of FIG. 6*a*.

In embodiments, and with reference to FIGS. 1 to 4*k*, the seating device 1 of the invention is a portable and folding seating device 1 configured to be placed on any type of seat, chair, bench, and/or on any substantially flat and horizontal surface such as for example the ground. With reference to FIGS. 1 and 2*a*, the seating device 1 comprises a base plate 2 to sit on and a pelvic support 3 fixed to the base plate 2 by a hinge 4. The hinge 4 is preferably located at or close to a back edge 21 of the base plate 2.

In a folded position schematically illustrated in FIG. 1 by an illustrative but in no way limiting example, the pelvic support 3 lies substantially parallel to the base plate 2, preferably as dose as possible to said base plate 2 in order to minimize the overall dimensions of the folded seating device 1.

Most existing seats have a backward-sloping seat pan: movie theaters, conference chairs, restaurant seating, etc. Private vehicle seats are usually cupped or a "bucket" seat, with a large negative slope. As this slope is highly variable, any device attempting to correct the slope must be adaptable to a variety of seats. There are several seating surfaces without a seat back, such as park benches, sports stadium benches and bar stools. Most modem couches and sofas are too deep, front edge to bad<support, to sit correctly. The portable seating device according to embodiments of the present invention allows for correctly supported seating in these environments. Easy portability of the seating device allows a user to carry his or her seating device 1 in a bag, computer case or backpack to the car seat, work environment, movies, restaurant, conferences, etc. Preferably, this permits the user to purchase one seating device 1 for all seats.

In embodiments, the seating device 1 comprises a handle 20 for holding the seating device 1, for example when carrying it in its folded position. In the embodiment illustrated in FIGS. 1 and 2*a*, the handle 20 is formed in the base plate 2, for example at or close to a front edge 22 of the base plate 2. The handle 20 for example comprises a hole 200 cut out of the front center of the base plate 2 and allowing a user to insert his or her fingers in said hole 200 when carrying the seating device 1. Other types of handles and/or other locations for the handle are however possible within the frame of the invention. In variant embodiments, the handle is for example located near the hinge. In embodiments, the handle is a soft, rigid or semi-rigid element attached to the base plate and/or to the pelvic support.

The hinge 4 allows unfolding the seating device 1 in an unfolded position in which the pelvic support 3 forms an angle of approximately 90° with the base plate 2, such that the pelvic support 3 is in a vertical position when the base plate 2 is placed on a substantially horizontal surface, as illustrated in FIG. 2*a* by an illustrative but in no way limiting example.

In embodiments, the base plate 2 comprises depressions 201 for lodging ischial tuberosities of a user seating on the seating device 1 and thereby providing improved support at said ischial tuberosities, as explained further below.

FIG. 2*b* illustrates a seating device 1 according to a variant embodiment of the invention, according to which the pelvic support 3 is T-shaped, wherein the branches of the thus formed "T" provide lateral support elements 30 for supporting the iliac crest of a user seating on said seating device 1, as explained further below. Preferably, the lateral support elements 30 extend laterally from the center of the pelvic support 3 and forward towards the front edge 22 of the base plate 2. Unless otherwise specified, the same reference numbers designate the same elements in all figures.

The base plate 2 is rigid and preferably relatively thin. In embodiments, as illustrated for example in FIG. 3*a*, the base plate 2 is slightly wedge-shaped, for example thicker at the back edge 21 than at the front edge 22, resulting in a tilt of for example 5 degrees, the upper side 23 of the base plate 2 sloping slightly forward when the lower side 24 of the base plate 2 is substantially horizontal. This tilt, or angle between the upper side 23 of the base plate 2 and the lower side 24 of the base plate 2, insures relaxation of the hip flexor muscles of a user sitting on the seating device 1, without pelvic retroversion. The angle between the upper side 23 of the base plate 2 and the lower side 24 of the base plate 2 is for example comprised between 3° and 7°, for example approximately 5°. Other angle values are however possible within the frame of the invention. In embodiments, the upper side and the lower side of the base plate are for example parallel to each other such that the upper side is horizontal when the lower side is placed horizontally.

With reference to the FIGS. 1, 2*a*, 3*a* and 3*b*, the pelvic support 3 is attached to the base plate 2 through the hinge 4. The pelvic support 3 is for example a rigid and preferably relatively thin plate. In embodiments, the pelvic support 3 is for example substantially of the same thickness as the base plate 2. When the seating device 1 is in its folded position, the pelvic support 3 for example lies flat onto the base plate 2. Preferably, the seating device comprises a mechanism, not visible on the figures, to hold the pelvic support 3 against the base plate 2 when the seating device 1 is in its folded position, for example for it to stay dosed while carrying. The pelvic support 3 for example clicks into place, for example at the hinge, when the seating device 1 is folded. Other mechanisms are however possible within the frame of the invention for holding the pelvic support 3 against the base plate 2 when the seating device 1 is in its folded position. These mechanisms for example include a hook and loop locking mechanism, a latch mechanism, a "Velcro" type attachment or any other suitable mechanism.

When the seating device 1 is in its unfolded position, the pelvic support 3 forms an angle of substantially 90° with the base plate 2, more specifically with the lower side 24 of the base plate 2. The pelvic support 3 is thus in a substantially vertical position when the base plate 2 is placed on a substantially horizontal surface, as illustrated for example in FIGS. 2*a*, 2*b* and 3*a*. With reference to FIG. 3*b*, the rotation of the pelvic support 3 relative to the base plate 2 is stopped when the seating device is in its unfolded position, such that the angle between the pelvic support 3 and the base plate 2 cannot be further increased. In embodiments, the pelvic support 3 clicks into place when the seating device 1 is unfolded and/or its rotation is stopped by cooperating profiles 39, 29 of the pelvic support 3 and of the base plate 2 respectively. When the seating device 1 is in its unfolded position, the pelvic support 3 provides a rigid, and in some embodiments locked, support for the pelvic bones. As explained below, the height of the pelvic support 3 over the base plate 2 when unfolded is adapted to the height of the sacro-iliac articulations to be supported.

In embodiments illustrated by ways of illustrative but in no way limiting examples in FIGS. 4*a* to 4*k*, the base plate 2 further comprises an extension device to allow maintaining the lower side 24 of the base plate 2 horizontal, when the seating device 1 is placed for example on chairs or seats that are deep or slope backward, for example, but not only, on car seats, cinema seats, etc. Positioning the lower side 24 of the base plate horizontally ensures a vertical positioning of the pelvic support 3 and, when applicable, a slight forward sloping of the upper side 23 of the base plate 2 when the seating device 1 is in its unfolded position.

The extension device for example comprises one or more adjustable elements protruding from the lower side 24 of the base plate 2, such as for example a pair of adjustable feet 25 on either side of the back edge 21 (FIGS. 4*a* to 4*f*), a set of blocks 26 of various sizes (FIGS. 4*g* and 4*h*) to be inserted in a corresponding blind hole 27 on the lower side 24 of the base plate 2, or an adjustable bar or plate, or any other suitable device. For larger adjustments, for example for bucket car seats or soft couches, and with reference to FIGS. 4*i* and 4*j*, the extension device comprises one or more support wedges 28 for example of various sizes, to add the necessary support depth. In embodiments, the height of the extension device is adjustable continuously or step-by-step, for example up to an angle of 10°, 15° or 20° between the lower side 24 of the base plate 2 and the surface on which the seating device is placed. FIG. 4*k* illustrates a further embodiment in which the lower side 24 of the base plate 2 is convex in order to encourage the user's upper body mobility, preferably up to 10 degrees of lateral and/or forward-back motions, without creating muscle strain.

In embodiments, the seating device further comprises one or more mechanical and/or electromechanical "bubble levels" 5 integrated into the base plate 2 to allow the user to adjust the seating device for correct base plate 2 alignment, thus insuring the pelvic support 3 is vertical. The one or more bubble levels 5 are for example connected to an electronic controller that sends a status signal of the alignment of the seating device 1 on the chair or other surface. The status signal for example triggers an acoustic signal when the alignment is not correct, or sends a signal to a portable device, for example to a smartphone, wirelessly connected to the electronic controller, wherein the portable device displays the alignment information to a user who can then correct the alignment.

The seating device 1 of the invention, in particular the base plate 2, is preferably wide enough to take the weight of the upper body at the ischial tuberosities and gluteal muscles, thereby holding the base plate 2 in place. The base plate 2 is preferably long enough to be comfortable under the thighs, in embodiments slightly more flexible and thin near the front edge to prevent pinching the thighs, and optionally rounded at the lateral edges for comfort. In embodiments, the base plate 2 comprises depressions 201 for receiving the ischial tuberosities of a user seating on the seating device 1, thereby providing additional support to and insuring a correct alignment to the pelvis of the user seating on the seating device 1 of the invention.

The dimensions of the pelvic support 3 and of the base plate 2, in particular their length and width, are preferably adapted to the size of the user.

In embodiments, the height of the pelvic support 3 over the upper side 23 of the base plate 2 is for example 1 cm higher than the height of the posterior superior iliac spine, thereby allowing support to the pelvis without supporting the spine of a user sitting on the seating device. Typical dimensions for the height of the pelvic support 3 in seating devices 1 adapted for adults and adolescents are 16 cm, 20 cm and 24 cm.

In embodiments, the width of the pelvic support 3 is for example 4 cm wider than the width of the posterior superior iliac spine, thereby allowing support to the pelvis without supporting or immobilising the spine of a user sitting on the seating device. This allows providing comfortable seating to a user, while allowing the use of the seating device 1 on most chairs or seats. Typical dimensions for the width of the pelvic support 3 in seating devices 1 adapted for adults and adolescents are 18 cm, 20 cm and 22 cm.

In embodiments, the pelvic support 3 is T-shaped and thereby comprises lateral support elements 30 that provide support to the iliac crest of a user sitting on the seating device 1.

In embodiments, the length of the base plate 2 is approximately 30 cm, which is usually long enough to allow thigh weight to immobilize the pelvic support 3 with minimal plate edge pressure on thighs, and short enough to fit in almost all chairs, seats and/or benches.

In embodiments, the width of the base plate 2 is for example 10 cm wider than the distance between outer edges of wide gluteal tuberosities, which spreads body weight of a user seating on the seating device 1 between the thighs and the ischial tuberosities for comfort. Typical dimensions for the width of the base plate 2 in seating devices 1 adapted for adults and adolescents are 24 cm, 28 cm and 32 cm.

FIGS. 5*a* and 5*b* schematically illustrate the seating device of the invention 1 supporting the pelvis of a female and of a male user respectively. When a user correctly seats on the seating device 1 of the invention, the ischial tuberosities 90 rest on the base plate 2, for example in the depressions 201, while the pelvis support 3 supports the back of the pelvis 9 at the posterior superior iliac spines (PSIS) 91, without any contact to the vertebrae. The spine is thus free to align naturally without excessive muscular effort or tension for the user. In embodiments, the pelvic support 3 comprises a protrusion 31 for ensuring the pelvic support 3 only contacts the pelvis 9 at said PSIS 91.

FIGS. 5*c* and 5*d* schematically illustrate the seating device of the invention 1 with a T-shaped pelvic support 3 supporting the pelvis of a female and of a male user respectively. When a user correctly seats on the seating device 1 of the invention, the ischial tuberosities 90 rest on the base plate 2, for example in the depressions 201, while the pelvis support 3 supports the back of the pelvis 9 at the posterior superior iliac spines (PSIS) 91, without any contact to the vertebrae, and the lateral support elements 30 additionally support the iliac crests 92 The spine is thus free to align naturally without excessive muscular effort or tension for the user. In embodiments, the pelvic support 3 comprises a protrusion 31 for ensuring the pelvic support 3 only contacts the pelvis 9 at said PSIS 91 and at said iliac crests 92.

In embodiments the seating device 1 of the invention has a non-slip upper side 23 and/or lower side 24 to maintain stability. The area around the hinge 4, in particular the back edge 21 of the base plate 2, is preferably rounded and smooth to prevent damage to upholstered seats and/or chairs.

In embodiments, the seating device 1 of the invention is preferably lightweight and small enough to fit into a backpack, briefcase, or large purse. The material used for the seating device 1, in particular the material of the base plate 2 and of the pelvic support 3 is preferably rigid, lightweight and durable.

The shapes and dimensions of the seating device of the invention as described above are given as illustrative examples. Other shapes and/or dimensions of the elements of the seating device are possible within the frame of the invention.

FIGS. 6*a*, 6*b* and 7 for example show other embodiments of seating devices of the invention in the form of a seat, for example an office chair, with a low vertical backrest acting as the pelvic support 3 of the invention, a seat acting as the base plate 2 of the invention and at least one foot 6 for holding said seating device 1 at a distance over the ground. In embodiments, the tilt of the seat or base plate 2 of the seating device 1 of FIGS. 6*a*, 6*b* and/or 7 is adjustable, continuously or step-by-step, for example between 0° and 7°, preferably between 3° and 7°.

The invention claimed is:

1. Seating device comprising:

a base plate for a user to sit on; and a pelvic support for supporting in a vertical position the pelvis of a user sitting on said base plate without supporting or immobilizing said user's vertebrae, wherein said pelvic support is configured for contacting said pelvis at the posterior superior iliac spines (PSIS) and/or at the iliac crests, without any contact to said user's vertebrae, wherein said seating device is configured for providing an angle of 93° to 97° between the pelvic support and the upper side of the base plate.

2. Seating device according to claim 1, wherein said seating device is foldable and further comprises a hinge, for attaching said pelvic support at or near a back edge of said base plate such that when the seating device is in a folded position, the pelvic support lies substantially parallel to the base plate, and when the seating device is in an unfolded position the pelvic support is stopped at an angle of 93° to 97° with an upper side of said base plate.

3. Seating device according to claim 2, wherein said base plate is thicker at said back edge than at a front edge and said upper side of said base plate forms an angle comprised between 3° and 7° with a lower side of said base plate and said pelvic support is stopped at an angle of substantially 90° with said lower side of said base plate when the seating device is in an unfolded position.

4. Seating device according to claim 2, further comprising an adjustable extension device for maintaining a lower side of said base plate in a horizontal position when the seating device lies on an inclined surface.

5. Seating device according to claim 4, wherein said adjustable extension device is attached to said base plate at or near said back edge.

6. Seating device according to claim 4, wherein said adjustable extension device allows maintaining a lower side of said base plate in a horizontal position when the seating device lies on an surface inclined at up to 20°.

7. Seating device according to claim 4, wherein said adjustable extension device is continuously adjustable.

8. Seating device according to claim 2, wherein said base plate comprises means for indicating the inclination of said base plate.

9. Seating device according to claim 8, wherein said means for indicating the inclination of said base plate comprises a bubble level or wireless transmission means for wirelessly communicating with a remote handheld device.

10. Seating device according to claim 2, wherein said lower side is convex.

11. Seating device according to claim 2, further comprising a handle for carrying said seating device in a folded position.

12. Seating device according to claim 11, wherein said handle comprises a hole cut out at a front edge of said base plate.

13. Seating device according to claim 2, further comprising a locking mechanism for holding said pelvic support against said base plate when said seating device is in a folded position.

14. Seating device according to claim 2, further comprising a. mechanism for stopping said pelvic support at an angle of substantially 90° with said base plate when said seating device is in an unfolded position.

15. Seating device according to claim 2, wherein a height of the pelvic support over the back edge of the base plate when the seating device is in its unfolded position is lower or equal to 24 cm.

16. Seating device according to claim 15, wherein said height of the pelvic support is comprised between 16 cm and 24 cm.

17. Seating device according to claim 1, wherein said seating device is a chair and further comprises at least one foot for holding said base plate over the ground, an upper side of said base plate forming an angle of 3° to 7° with the ground, said pelvic support being substantially vertical and forming a support for the PSIS protuberances, the iliac crests, or both.

18. Seating device according to claim 17, wherein said height of the pelvic support is lower or equal to 24 cm.

19. Seating device according to claim 17, wherein said pelvic support comprises lateral support elements configured for additionally contacting said pelvis at the iliac crests and/or the base plate comprises depressions for lodging ischial tuberosities of a user seating on said seating device.

20. Seating device according to claim 1, wherein said pelvic support comprises lateral support elements configured for additionally contacting said pelvis at the iliac crests and/or the base plate comprises depressions for lodging ischial tuberosities of a user seating on said seating device.

* * * * *